US006786703B2

(12) United States Patent
Breindel et al.

(10) Patent No.: US 6,786,703 B2
(45) Date of Patent: Sep. 7, 2004

(54) VARIABLE CAPACITY AIR CONDITIONING COMPRESSOR WITH IMPROVED CRANKCASE OIL RETENTION

(75) Inventors: John A. Breindel, Getzille, NY (US); David Michael Ebbing, Clarence Center, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/282,661

(22) Filed: Oct. 29, 2002

(65) Prior Publication Data

US 2003/0086791 A1 May 8, 2003

Related U.S. Application Data

(60) Provisional application No. 60/335,344, filed on Nov. 2, 2001.

(51) Int. Cl.[7] ..... F04B 1/26
(52) U.S. Cl. ..... 417/222.2; 417/269; 92/12.2
(58) Field of Search ..... 417/222.2, 222.1, 417/269, 270, 222; 92/12.2

(56) References Cited

U.S. PATENT DOCUMENTS 4,061,443 A 12/1977 Black et al. ..... 417/222
4,174,191 A 11/1979 Roberts ..... 417/222
4,428,718 A 1/1984 Skinner ..... 417/222
4,502,844 A * 3/1985 Kimura et al. ..... 417/275
5,720,215 A 2/1998 Asplund et al. ..... 92/71
5,741,122 A * 4/1998 Yokono et al. ..... 417/222.2
6,068,452 A * 5/2000 Okada et al. ..... 417/223
6,102,669 A * 8/2000 Fujita ..... 417/222.2
6,164,929 A * 12/2000 Kazuya et al. ..... 417/362
6,546,841 B2 * 4/2003 Kato et al. ..... 92/71

* cited by examiner

*Primary Examiner*—Justine R. Yu
*Assistant Examiner*—Han L Liu
(74) *Attorney, Agent, or Firm*—Patrick M. Griffin

(57) ABSTRACT

An automotive air conditioning compressor with a capacity control valve improves oil retention in the crankcase with a crankcase to suction chamber passage that is formed through the central shaft. The passage inlet opening in the shaft is located within a central chamber inset into the cylinder block, and is thereby sheltered from the main chamber of the crankcase, although still open to the crankcase. So sheltering the inlet of the shaft passage between crankcase and suction chamber isolates the inlet from the greater turbulence and higher velocity gradients within main chamber of the crankcase. Less oil is thus forced through the passage and back out of the crankcase.

4 Claims, 3 Drawing Sheets

VARIABLE CAPACITY AIR CONDITIONING COMPRESSOR WITH IMPROVED CRANKCASE OIL RETENTION

PRIOR APPLICATION

This application claims the benefit of prior Provisional Patent Application Serial No. 60/335,344 filed Nov. 2, 2001.

TECHNICAL FIELD

This invention relates to variable capacity air conditioning compressors in general, and specifically to such a compressor with improved crankcase oil retention.

BACKGROUND OF THE INVENTION

Piston driven automotive air conditioning compressors with variable capacity generally vary the piston stroke by allowing the angle of a nutating piston driving plate to change relative to the centerline of a drive shaft. Smaller angles yield a shorter nutation and shorter piston stroke, and larger angles create a loner piston stoke. The tilting plate may be of the unitary type that directly drives the pistons (swashplate), or a compound type that indirectly drives the pistons (wobble plate). In either case, a plate tilt mechanism consists of several sliding and pivoting members located behind the pistons and within the main hollow body of the compressor housing, the so called "crankcase" volume. All rubbing interfaces within the compressor and the crankcase, including the tilt mechanism, require sufficient lubrication for proper operation, and this depends on lubricant being carried to different parts of the compressor by the refrigerant in which it is entrained. To the extent that lubricant is well retained within the crankcase, these sliding interfaces are well lubricated.

The compressor pumping capacity can be controlled by allowing the plate to shift to a different angle, rather than externally physically moving it along the shaft. This is done by controlling the net pressure differential between the front or head of the pistons and the rear of the pistons. The back of the pistons face the inner volume or crankcase, while the heads of the pistons face the pressure in a suction chamber, and the two pressures between which the differential exists can be referred to as crankcase and suction pressure. When there is substantially a zero crankcase-suction pressure differential, there is no net resistance preventing the piston from moving back as far as it can, so that the plate is allowed to shift to its largest angle relative to the shaft centerline, creating the longest piston stroke. At the highest pressure differential, there is the highest net resistance to the piston backstroke, so the plate shifts to the smallest angle relative to the shaft centerline, creating the shortest stroke of the piston.

A capacity control valve in the compressor body controls the net pressure balance on the piston by controlling refrigerant gas flow into or out of the crankcase. The valve can be responsive to both suction pressure and discharge pressure to control selective communication of compressor discharge and suction chambers with the crankcase, thereby controlling the net pressure balance on the pistons (and thereby controlling the effective piston stroke and capacity). The controlled refrigerant flow requires the provision of a flow passage for gas flow from the crankcase to the control valve and ultimately to the suction chamber, and, in swashplate compressors, such crankcase to suction passages typically been bored through the back of the cylinder block, the structural member in which the piston cylinders are formed.

This is further described below in the description of FIG. 1. As such, the inlet opening of the crankcase to suction cavity passage flow passage has been directly and clearly exposed to the crankcase, and thereby directly exposed to the greatest swirl and velocity of refrigerant gas. Oil in the compressor which would otherwise be retained can be easily blown out. In a wobble plate compressor, the equivalent crankcase to valve to suction chamber flow passage is bored through the central shaft and part of the plate tilt mechanism, with the inlet opening to the passage located even more deeply into the crankcase volume and even more exposed.

SUMMARY OF THE INVENTION

The subject invention provides a variable capacity compressor in which the initial portion of the crankcase-to control valve-to suction chamber passage is bored through the central drive shaft, rather than through the cylinder block, but in which the inlet opening is not exposed directly to the main portion of the crankcase. Instead, the inlet opening is sheltered within a central cylinder block bore, inset from the plane of the back of the cylinder block, and therefore isolated from the more turbulent main portion of the crankcase. Within the sheltered and isolated volume surrounding the inlet passage, the refrigerant is less turbulent, carries less entrained lubricant, and, therefore, less lubricant is forced out of the crankcase with the flow of refrigerant through the passage.

DESCRIPTION OF THE PREFERRED EMBODIMENT

Figure 1:
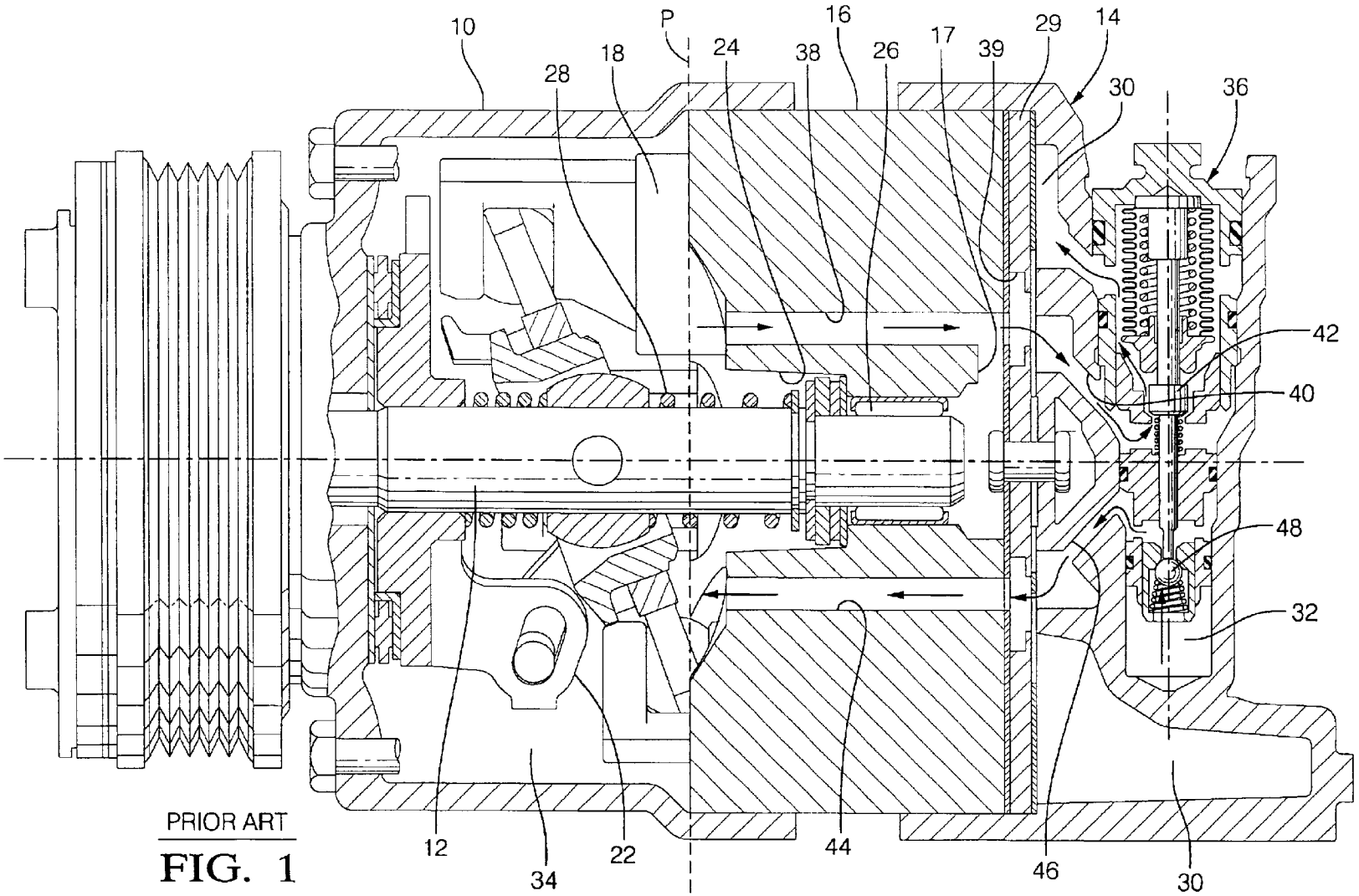
PRIOR ART FIG. 1
FIG. 1 is a cross section of a prior art compressor.

Referring first to FIG. 1, a variable capacity compressor of the swashplate type has a generally cylindrical housing 10 and a central drive shaft 12 and a rear head, indicated generally at 14, within which various chambers and bores are cast and machined. Contained within housing 10, near the rear end cap 14 is a cylinder block, indicated generally at 16, the front face of which abuts substantially flat against a valve plate 29, but for a notch 17 that serves a purpose described below. Block 16 is bored to accommodate several pistons, one of which is indicated at 18. The pistons 18 are arrayed about drive shaft 12, which drives a tiltable swash plate mechanism 22 to, in turn, reciprocate the pistons 18 back and forth, over a stroke length determined by the angle of the mechanism 22 relative to the shaft 20. The mechanism 22 is designed to assure that the forwardmost point of the piston stroke is always the same, but the rearmost point will vary, as described further below. At the center of cylinder end of shaft 20 concentrically within bore 24, and for one end of a return spring 28 for the tilt mechanism 22. Bore 24 is inset from a plane P generally defined by the back of cylinder block and, conventionally, has no purpose other than that just described. The end of shaft 20 is spaced away from valve plate 29, which is sandwiched between rear head 14 and cylinder block 16.

Still referring to FIG. 1, rear head 14 contains a peripheral intake or suction chamber 30, out of which each piston 18 draws refrigerant from a non illustrated evaporator. Rear head 14 also contains a central discharge chamber 32, into which each piston 18 pushes compressed refrigerant vapor, which then flows to a non illustrated condenser. Outboard of the plane P is an internal volume that is referred to as the crankcase 34, within which the mechanism 22 is enclosed. All rubbing interfaces located within the crankcase 34 require adequate lubrication, lubricant which is carried by the inflow of refrigerant vapor, but which can be carried out by the outflow of vapor, as well. The inflow of vapor from discharge chamber 32 to crankcase 34, and the outflow of refrigerant vapor (and lubricant) from crankcase 34 to suction chamber 30, is controlled by a capacity control valve, indicated generally at 36, located in rear head 14. This controlled gas inflow and outflow balance thereby controls the pressure within crankcase 34, relative to the pressure in suction chamber 30, so as to control the net force balance on the reciprocating pistons 18, and ultimately to control their stroke length. Specifically, when reduced capacity and stroke length is required, more vapor is routed out of crankcase 34 into the suction chamber 30, and less or no vapor routed in from discharge chamber 32, so that a reduced or almost zero net piston force balance is established. Conversely, when higher capacity and stroke length are needed, less or no vapor is routed out of crankcase 34 into suction chamber 30, and more vapor is pumped in from discharge chamber 32, 50 that a higher net piston force balance is created. Further description of just how valve 36 works may be found in co-assigned U.S. Pat. No. 4,428,718, hereby incorporated by reference. This control scheme obviously requires a physical flow passage between the crankcase 34 and the two chambers 30 and 32, described in more detail next.

Still referring to FIG. 1, in the embodiment disclosed, the flow path out of crankcase 34 consists of a initial passage, indicated at 38, bored through cylinder block 16, opening across notch 17 to a hole 39 through valve plate 29 and then into a passage 40 formed in rear head 14. Notch 17 is not a necessary part of the vapor flow path per se, and is, in fact, intended to make the flow path more tortuous, to try to reduce lubricant loss from crankcase 34. Rear head passage 40 then opens below a suction control valve portion 42 of valve 36, and ultimately into suction chamber 30. The flow path between discharge chamber 32 and crankcase 34 likewise consists of passage 44 bored through cylinder block 16, opening into a shorter passage 46 in rear head 14 that opens below a discharge control valve portion 48 of control valve 36, and ultimately into discharge chamber 32. As shown by the arrows, gas flow is always out of crankcase 34 and into suction chamber 30, when there is flow, and that flow rate is regulated by the portion 42 of control valve 36. Likewise, gas flow is always out of discharge chamber 32 and into crankcase 34, when there is flow, and that flow rate is regulated by the portion 48 of control valve 36. Since they are bored through the cylinder block 16, the inlet opening from the two flow paths to the crankcase 34 is directly exposed to the crankcase 34. In the case of the "from discharge" flow path, this is not a problem, since gas and lubricant flow would be always into crankcase 34, when there was flow. In the case of the "to suction" flow, however, the direct presentation of the inlet of the passage 38 to the crankcase 34, and to the most turbulent flow within crankcase 34, does allow a direct and efficient flow path of lubricant out of crankcase 34. As noted above, an alternate crankcase to suction flow path found in the prior art is one formed through the drive shaft 12 and through the central part of the tilt mechanism of a wobble plate, which thus has an inlet that is located even deeper within the crankcase 34, as may be seen in U.S. Pat. No. 4,428,718 noted above. Consequently, a high charge of lubricant in the system is necessary to assure that enough lubricant will be retained within crankcase 34 at all times to assure adequate lubrication of the various rubbing interfaces located within it.

Figure 2:
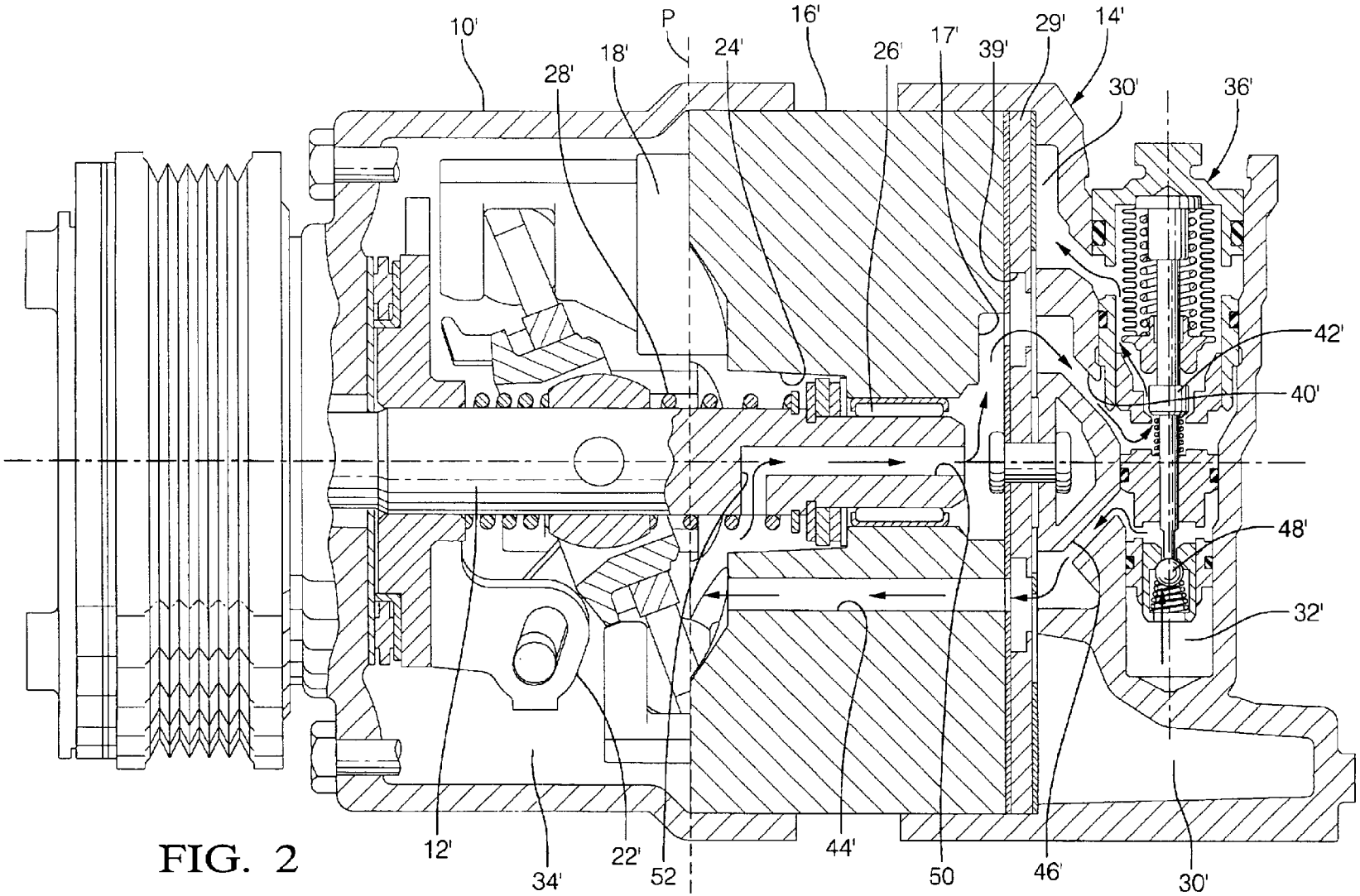
FIG. 2 is a cross section of a compressor incorporating the differently configure crankcase to suction flow passage of the invention.

Referring next to FIG. 2, a preferred embodiment of the invention includes the same basic components and parts, which are labeled with the same number primed. The discharge to crankcase flow path is the same, with the same passage 44' opening through cylinder block 16, and the capacity control valve 36' works the same way. Now, however, the initial part of the flow path out of crankcase 34' is formed in a new manner. An initial flow passage 50 is bored through the end of drive shaft 12', with an outlet through the end face of the end of shaft 12' and into the central bore 24', and with an inlet opening 52 that is bored at a right angle thereto, axially spaced from the end face of shaft 12'. The inlet opening 52 is sheltered within the central bore 24', inset from the plane P and isolated from the turbulence within the main volume of the crankcase 34'. Gas flow from the main volume of crankcase 24' can flow into one end of the central bore 24', into the inlet 52, out the passage 50, through the other end of the bore 24' and, conveniently, through the pre existing notch 17' and ultimately through valve plate hole 39' and into the same passage 40' in rear head 14'. So, notch 17' now acts to assist, rather than retard, vapor flow. Rear head passage 40', as before, opens into suction chamber 30' in a controlled fashion across the control valve portion 42'. Gas flow out of crankcase 34' to the suction chamber 30' is just as efficient as in the prior design, if not more so, but lubricant is not blown out as readily. This is due in part to a centrifugal slinging action out of the inlet opening 52 in the spinning shaft 12', but mostly to the sheltered, isolated location of the inlet opening 52, protected from the turbulence and high velocity gradients within the crankcase 34'. An additional advantage is thereby garnered from the central bore 24' at essentially no extra cost.

Figure 3:
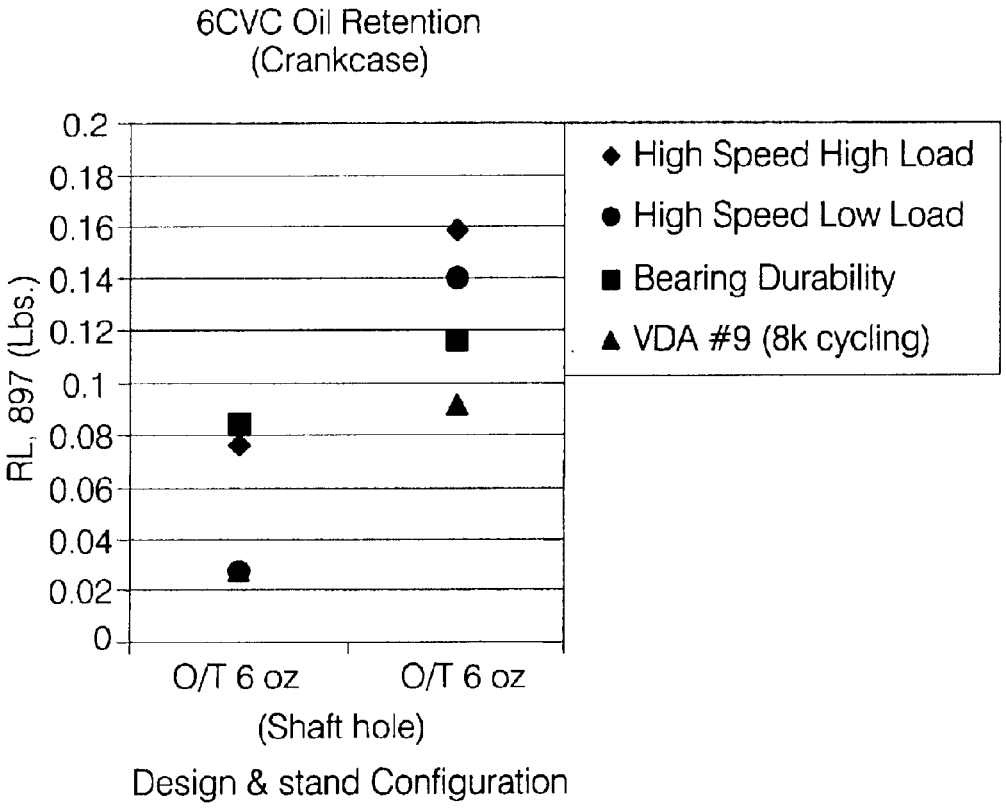
FIG. 3 is a graph showing a comparison of the performance, in terms of crankcase lubricant retention, of the FIG. 1 and FIG. 2 type of compressor.

Referring next to FIG. 3, comparative test results are shown for a six cylinder variable capacity compressor of the type shown in FIGS. 1 and 2 above. Each was used in a system with a fixed orifice refrigerant expansion valve ("O/T"), and the total system charge was 6 ounces of a lubricant called RL-897, well know to those skilled in the art. Several different tests were run, as shown by the legend, including high speed tests with high and low loading, a test of bearing durability, and a long term durability test of a type required by German testing standards ("VDA"), also known to those skilled in the art. Lubricant retention in the crankcase was measured and was significantly higher for the compressor shown in FIG. 2. Clearly, this was due to the new location of the crankcase to suction flow passage shown, given the fact that that was the only structural change.

Variations in the particular form of the passage 50 shown. For example, the shaft passage could be drilled as a single passage at an angle, so that the inlet opening was not part of a separate leg of an L shaped passage as shown at 52. Or, the second leg 52 could itself be at a slight angle, or consist of two or more separate bores, or both. In any event, the inlet opening or openings to the through-shaft flow passage would be sheltered within the central bore 24' in the cylinder block 16', giving the same improved crankcase oil retention. The flow path out of the end of the central bore 24' could be otherwise provided, as by a larger valve plate hole 39', or a notch formed into valve plate 29, instead of the pre existing notch 17'.

What is claimed is:

1. In a variable capacity piston refrigerant compressor of the type having a compressor housing, a cylinder block within the housing supporting an end of a central drive shaft concentrically within a central bore of said cylinder block and separating a head at one end of the housing from a crankcase volume within the housing, said cylinder block central bore being inset from a rear plane of said cylinder block and open at one end to said crankcase volume and open at the other end to a passage through said compressor head that opens into a suction chamber in said head, said compressor further including a capacity control valve that controls flow between said compressor head passage and suction chamber, the improvement comprising a passage formed through the end of said drive shaft having an inlet sheltered within said central bore, inset from said rear plane, and an outlet opening to the other end of said central bore so as to provide a flow path from said crankcase volume to said head passage and ultimately to said suction chamber.

2. A variable capacity piston refrigerant compressor according to claim 1, further characterized in that, said capacity control valve directly controls flow into said suction chamber across a suction control portion of said valve.

3. A variable capacity piston refrigerant compressor according to claim 1, further characterized in that, said passage through the end of said drive shaft has a single inlet opening.

4. A variable capacity piston refrigerant compressor according to claim 3, further characterized in that, said passage through the end of said drive shaft is generally L shaped.

* * * * *